US006603260B1

(12) United States Patent
Kim et al.

(10) Patent No.: US 6,603,260 B1
(45) Date of Patent: Aug. 5, 2003

(54) PLASMA DISPLAY PANEL WITH A GETTER MATERIAL

(75) Inventors: Tae Yun Kim, Kyungsangbuk-do (KR); Young Kook Kyon, Kyungsangbuk-do (KR)

(73) Assignee: Orion Electric Co., Ltd., Kyungsangbuk (KR)

( * ) Notice: Subject to any disclaimer, the term of this patent is extended or adjusted under 35 U.S.C. 154(b) by 0 days.

(21) Appl. No.: 09/600,349

(22) PCT Filed: Nov. 30, 1999

(86) PCT No.: PCT/KR99/00720

§ 371 (c)(1),
(2), (4) Date: Jul. 14, 2000

(87) PCT Pub. No.: WO00/33347

PCT Pub. Date: Jun. 8, 2000

(30) Foreign Application Priority Data

Nov. 30, 1998 (KR) ..... 98-52089

(51) Int. Cl.[7] ..... H01J 17/24; H01J 17/49; H01J 9/24

(52) U.S. Cl. ..... 313/562; 313/563; 313/553; 313/582; 313/609; 313/495; 445/24

(58) Field of Search ..... 313/582–587, 313/553–555, 561, 547, 495–497, 549, 484, 485, 559, 560, 609–611

(56) References Cited

U.S. PATENT DOCUMENTS 5,453,659 A * 9/1995 Wallace et al. ..... 313/495
5,938,494 A * 8/1999 Betsui et al. ..... 445/24
5,984,747 A * 11/1999 Bhagavatula et al. ..... 313/582
5,990,617 A * 11/1999 Kanae et al. ..... 313/582

* cited by examiner

*Primary Examiner*—Nimeshkumar D. Patel
*Assistant Examiner*—German Colón
(74) *Attorney, Agent, or Firm*—Notaro & Michalos P.C.

(57) ABSTRACT

A plasma display panel (PDP) is capable of directly and effectively removing impurities from a discharging space for enhancing the purity of a discharging gas. The PDP has a getter layer formed of at least a portion of a barrier rib. The getter layer is independently formed at an upper portion of each barrier rib with respect to each discharging cell or maybe formed to cross each other at every other cell with respect to the discharging cells formed in a direction in which the barrier ribs extend. The getter material particles are dispersed in an insulation material so that the getter layer has an electrical insulation characteristic.

8 Claims, 6 Drawing Sheets

PLASMA DISPLAY PANEL WITH A GETTER MATERIAL

TECHNICAL FIELD

The present invention relates to a plasma display panel and more particularly to a plasma display panel capable of improving the purity of a discharging gas by removing directly and effectively impurities within a discharging space.

BACKGROUND ART

As well known, a plasma display panel (referred to as PDP hereinafter), which displays a picture using a gas-discharge phenomenon, has been actively and increasingly researched and developed as a new generation display device such as a wall-hanging TV which can realize a large screen with its thin thickness.

FIG. 1 shows a structure of the most widely used AC PDP. As shown, electrodes E1 and E2 are on an upper substrate P1 and a lower substrate P2, respectively arranged so as to be orthogonal with each other and barrier ribs are formed to define discharging cells at the crossing portions of the electrodes E1 and E2. Formed on the space between the electrodes E1 and E2 is a discharging space into which a discharging gas is filled. A phosphor layer F is formed in the discharging cell so as to realize a predetermined brightness and contrast.

Meanwhile, a dielectric layer D is disposed on any one of the electrodes E1 and E2, for example, on the electrodes E2 when considering the PDP of a reflective type PDP in FIG. 1. When operating the AC PDP, wall charges are accumulated on the dielectric layer, triggering a discharging in the discharging cell, A protective layer may be formed, but not is represented in FIG. 1.

The upper electrodes E1 on the light transmission path are made of transparent electrodes, and in the case that there occurs a large voltage drop as in a large size display device, metal electrodes are additionally deposited thereon as bus electrodes. The lower electrodes E2 are commonly made of metal electrodes having a good conductivity.

However, such metal electrodes are composed of a metal material dispersed with a glass group ingredient, not a pure metal. Therefore, when sintering them or when operating the PDP, there may occur a problem that a metal ion emanating from the metal electrodes is diffused and migrated into adjacent functional layers.

To prevent it, a lower layer M is formed on the lower portion of the lower electrodes E2 in FIG. 1. Therefore, the migration phenomenon can be prevented and at the same time, a printing efficiency of functional layers such as electrodes can be improved.

However, in such a PDP structure, each of the functional layers E1, E2, B, D and the like is formed mainly by a printing method when manufacturing them; it is necessarily required to use a solvent in compounding a paste for a pattern printing. As the solvent, a volatile, organic solvent is mainly used in order to increase a drying speed.

The solvent is not completely exhausted in the course of drying and sintering the functional layers. As a result, the remaining solvent is slowly exhausted as an impurity only when operating the PDP, causing contamination of the discharging gas.

Accordingly, there is provided a getter for capturing the impurities and maintaining the purity of the discharging gas within the PDP.

FIG. 2 shows the conventional getter structures. As shown in the left lower portion of FIG. 2, an exhausting tube X is installed in the outside portion of the lower substrate P2, and a getter G is installed in the interior portion of a funnel formed by enlarging a connecting portion of the exhausting tube. In this construction, impurities within the discharging gas are captured through the discharging hole H.

However, since the discharging gas is isolated by the barrier rib, it is not easy to flow. Also, since the impurities are transmitted through only a small gap between the barrier ribs according to Dalton's diffusion law, the getter installed into the exhausting tube of the outside of PDP does not have substantially any effects. That is, there exists a problem that the effect of the getter in capturing the impurities and maintaining the purity of the discharging gas becomes tiny.

In addition, there is another example of a conventional getter G. As shown in the right side of FIG. 2, a getter hole H' is formed at the portion opposite to a ventilation hole H, and a getter cup U having the getter G therein is formed tightly at an outer portion thereof.

In the above-described structure, in the case that a plurality of getters G are not installed, it is impossible to obtain the desired effect of the getter G. In order to install a plurality of getters G, a plurality of getter holes H' are required. As a result, the strength of the lower substrate P2 may be decreased, and the fabrication cost of the same may be increased.

In the other construction example of the conventional getter G, as shown near the center portion of FIG. 2, a groove C is formed at the lower substrate P2, and the getter G may be formed in the groove C by a printing method or a charging method. Therefore, in this case, since the getter G can be installed nearest the discharging space, it is possible to obtain a superior capturing effect, compared to the others. In the above-described structure, however, since the getter layer G is overlapped with a phosphor layer F as shown in FIG. 1, it is impossible to be effectively installed in the discharging space V on which the phosphor layer F is formed. Therefore, it is impossible to effectively remove impurities from the discharging space.

In addition, according to the U.S, Pat. Nos. 5,453,659 and 5,520,563 granted to Robert M. Wallace, et al. in the title of "Anode plate for flat panel display having integrated getter and method of making a field emission device(FED) anode plate having an integrated getter", a plurality of electrically conductive regions are patterned on insulating layer. Conductive regions collectively comprise an anode electrode of a field emission flat panel display device. Luminescent material overlays conductors. An electrically insulating material is affixed to substrate in the spaces between conductors. By virtue of its electrical insulating quality, material serves to increase the electrical isolation of conductive regions from one another, thereby permitting the use of higher anode potentials without the risk of breakdown due to increased leakage current. A layer of a getter material overlays insulating material. A gap is left between the getter material and the luminescent material to maintain electrical isolation. However, differently from the FED, since wall charges are generated using a dielectric layer D and thus trigger a discharging in the PDP, it is impossible to additionally form such an insulation layer on the upper substrate P1 in the PDP.

SUMMARY OF THE INVENTION

Accordingly, it is an object of the present invention to provide a PDP capable of directly and effectively removing impurities from discharging spaces for thereby enhancing a purity of a discharging gas.

It is other object of the present invention to provide a PDP comprising a simple structure of getter layer, which can be manufactured at a low cost.

To achieve the above objects, in accordance with one embodiment of the present invention, in a PDP comprising an upper substrate and a lower substrate which are parallel to each other at a certain distance, a plurality of barrier ribs formed on the lower substrate for forming discharging spaces, address electrodes formed between each of the barrier ribs, a plurality of display electrodes formed on a surface of the upper substrate opposite to the lower substrate and crossing with the address electrodes, a plurality of discharging cells formed at cross portions between the address electrodes and the display electrodes, phosphor layers formed at portions between each of the barrier ribs, and a discharging gas tightly filled in the discharging spaces between the upper substrate and the lower substrate, a getter layer which is formed at a portion of each of the barrier ribs.

The getter layer can be prepared at portions of each of the barrier ribs with which the phosphor layer is not coated, by dispersing and forming getter material particles on an insulation material so as to have an electrical insulation characteristic.

Also, the getter layer may be independently formed at the upper portion of each barrier rib with respect to a discharging cell or may be formed to be crossed each other at every other cell with respect to a discharging cell formed in a direction that the barrier rib is extended. Even though the above structure may be formed by a sand blasting method, it can be formed easily and at a low cost by preparing a sheet which is consisted of powder layers bonded by a organic binder for forming the barrier rib and the getter layer, and by attaching the sheet to a given position of the discharging space and then sintering it.

The getter layer may be formed of a metallic compound which preferably has a black color. For example, the getter layer may be formed of element Zr, Ti, V, Al, Fe or the mixture of more than two elements among them.

As a result, the getter layer may be arranged in each discharging space, and it is possible to obtain an extended life span of the PDP by obtaining a certain purity of the discharging gas.

These and other advantages and features of the present invention will become more apparent from the description of the following preferred embodiment in reference to the accompanying drawings.

DETAILED DESCRIPTION OF THE PREFERRED EMBODIMENTS

Figure 3:
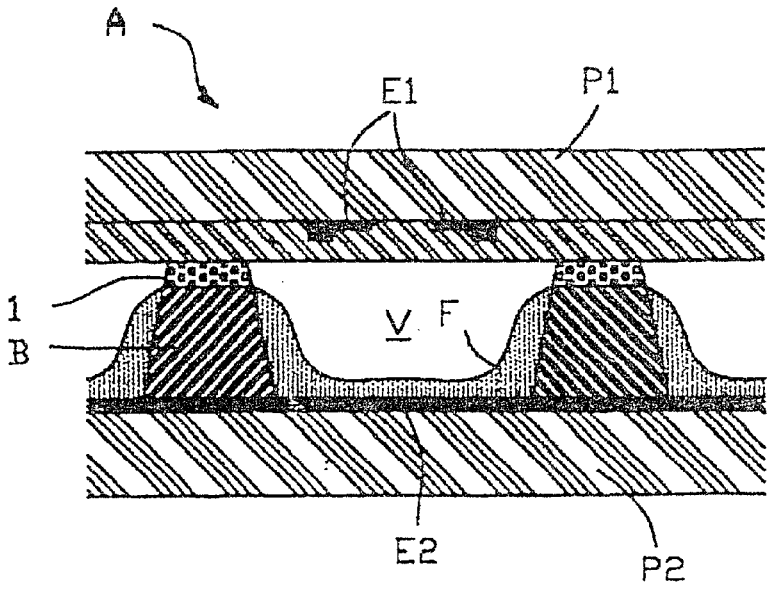
FIG. 3 is a partially sectional view illustrating one discharging cell of a PDP in accordance with one embodiment of the present invention.
Figure 4:
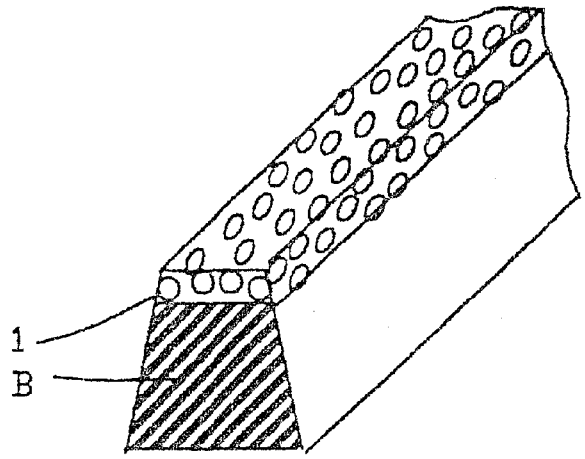
FIG. 4 is a perspective view illustrating the construction of only a barrier rib in FIG. 3.

FIG. 3 is a partially sectional view illustrating one discharging cell A of a PDP according to the present invention, and FIG. 4 is a perspective view illustrating the construction of only a barrier rib B in FIG. 3.

As shown in FIGS. 3 and 4, the PDP includes an upper substrate P1 and a lower substrate P2 which are parallel to each other at a certain distance. The lower substrate P2 includes address electrodes E2, and the upper substrate P1 includes plurality of pairs of display electrodes E1 and E1 which are opposite to address electrodes E2. A pair of display electrodes E1 and E1 are crossed by the address electrodes E2. One discharging cell A comprises a discharging space V in which the address electrodes E2 and the display electrodes E1 are crossed each other.

The discharging space V is formed in a stripe shape or a matrix shape between the upper substrate P1 and the lower substrate P2. A barrier rib B is formed on the lower surface P2 in a stripe shape or a matrix shape so that the address electrodes E2 passes through the center portion of the discharging space V.

A phosphor layer F is formed on at least one portion between each of the barrier ribs. A discharging gas is tightly filled in the discharging space V between the upper substrate P1 and the lower substrate P2.

As shown in FIGS. 3 and 4, in the PDP in which one discharging cell A is formed in the above-described manner, a barrier rib B according to the present invention includes a getter layer 1 at a portion exposed to the discharging space V.

Since the getter layer 1 is formed at the barrier rib B in such a manner that the getter layer 1 is exposed to the discharging space V, the impurity is immediately absorbed. When a certain impurity is exhausted from each of function layers E1, E2, D, B and F based on the remaining solvent during an operation of the PDP, thus it is possible to obtain a certain purity of the discharging gas in the discharging space V.

As shown in FIGS. 3 and 4, the getter layer 1 is formed by dispersing getter material particles in an insulating material so as to have an electrical insulation characteristic. In this case, it is preferred that the impurities may be removed more effectively by exposing the getter layer 1 to the surface of the barrier rib so as to have a large surface area thereof.

Figure 5:
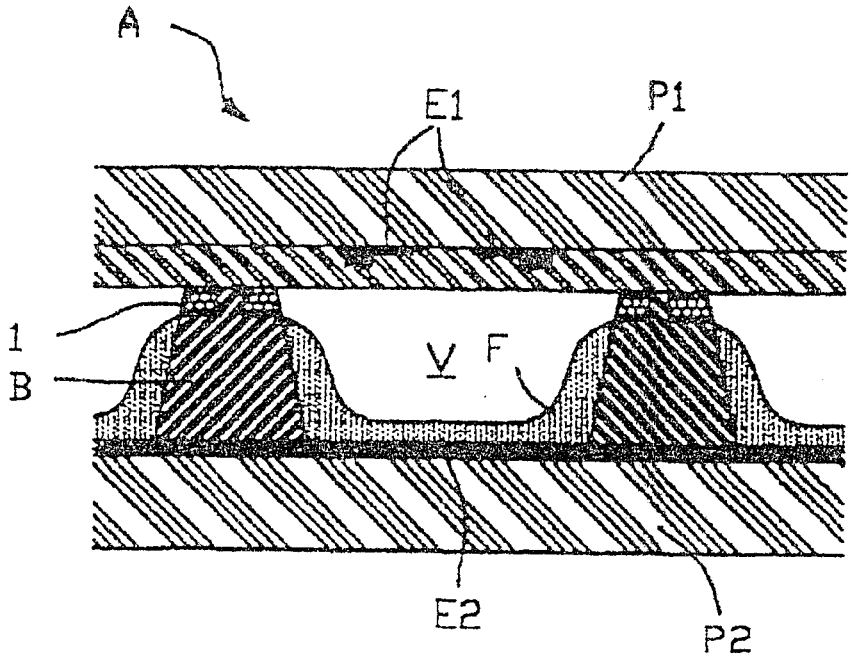
FIG. 5 is a partially sectional view illustrating one discharging cell of a PDP structure in accordance with other embodiment of the present invention.
Figure 6:
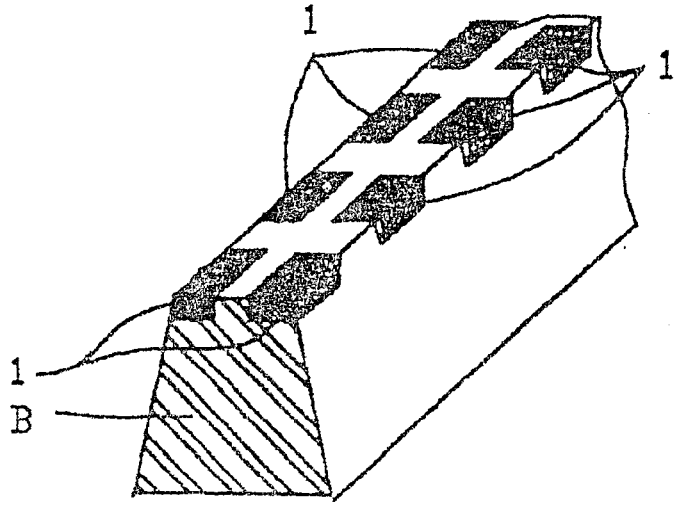
FIG. 6 is a perspective view illustrating a first embodiment of a configuration of getter structures formed on the barrier rib of FIG. 5.
Figure 7:
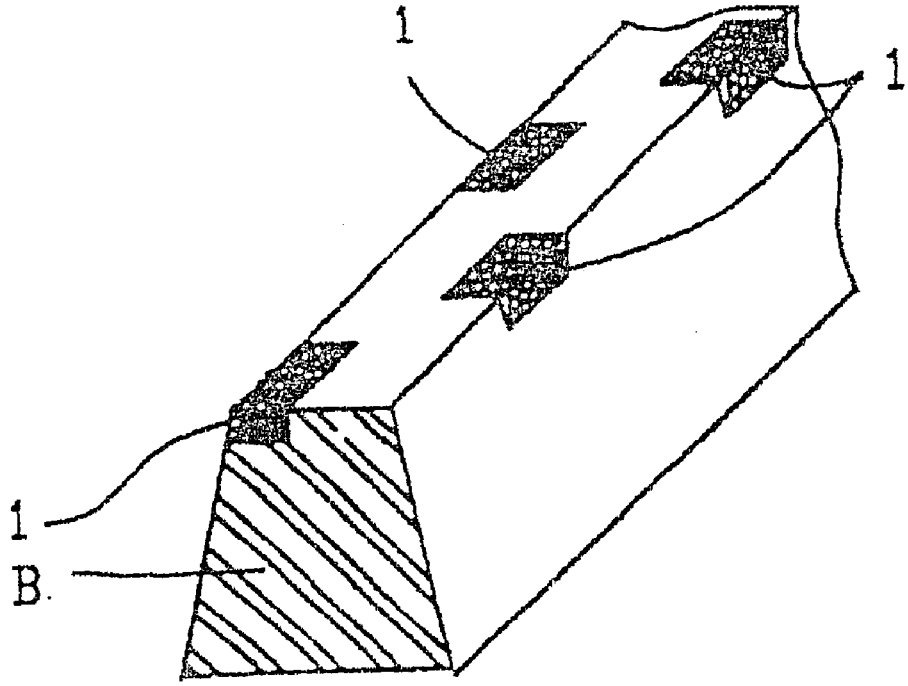
FIG. 7 is a perspective view illustrating a second embodiment of a configuration of getter structures formed on the barrier rib of FIG. 5.

FIG. 5 is a partially sectional view illustrating the construction of the PDP according to another embodiment of the present invention, and FIGS. 6 and 7 are perspective views of only the construction of the barrier rib in FIG. 5.

As shown in FIG. 6, the getter layer 1 is independently formed with respect to the unit discharging cell A. Namely, the getter layer 1 is separately formed at every unit discharging cell A about the barrier rib B only on the upper portion of the barrier rib B.

As shown in FIG. 7, when the getter layer 1 is formed in a stripe shape, the getter layer 1 is formed at every other cell at the one side of the discharging cells A which are formed in a certain direction that the barrier rib B is extended, and the getter layer 1 is formed at a portion, which is crossed by the one side of the discharging cell A, at the other side of the discharging cell A.

In such construction of the getter layer 1, an impurity is absorbed at a portion exposed to the discharging space V or at a small gap between the dielectric layer of the upper substrate P1 and the upper surface of the getter layer, thereby preventing a pollution of the discharging gas. The getter layer 1 is preferably formed of a metallic material, such as V, Al, Fe, etc, having depletion electrons so as to absorb oxygen and carbon. More preferably, the getter layer 1 is formed of a Zr or Ti-group compound having a black color, so that it is possible to enhance the contrast. In addition, since the getter layer 1 formed of a metallic material has a secondary electron discharging effect, it is possible to enhance the discharging strength.

In addition, in order to prevent an over-activation of the getter layer 1, a protection layer may be formed of a low melting point glass group material on the upper surface of the getter layer 1 for limiting the surface area thereof.

Figure 8:
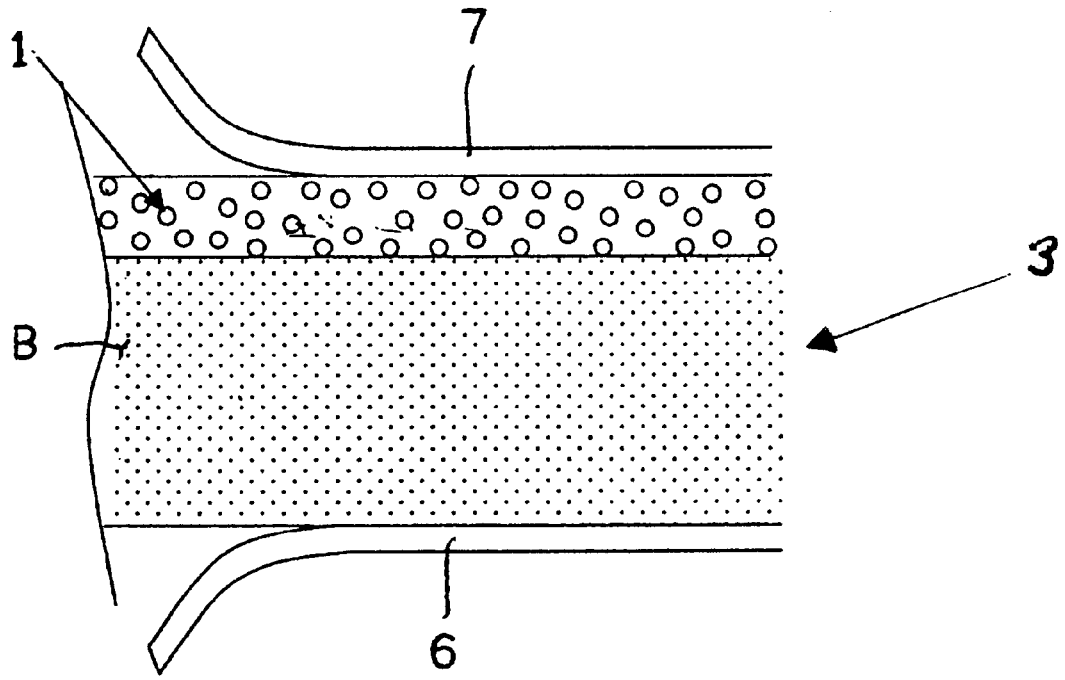
FIG. 8 is a partial sectional view illustrating a first embodiment of a sheet for forming the barrier ribs of FIGS. 4, 6, and 7.
Figure 9:
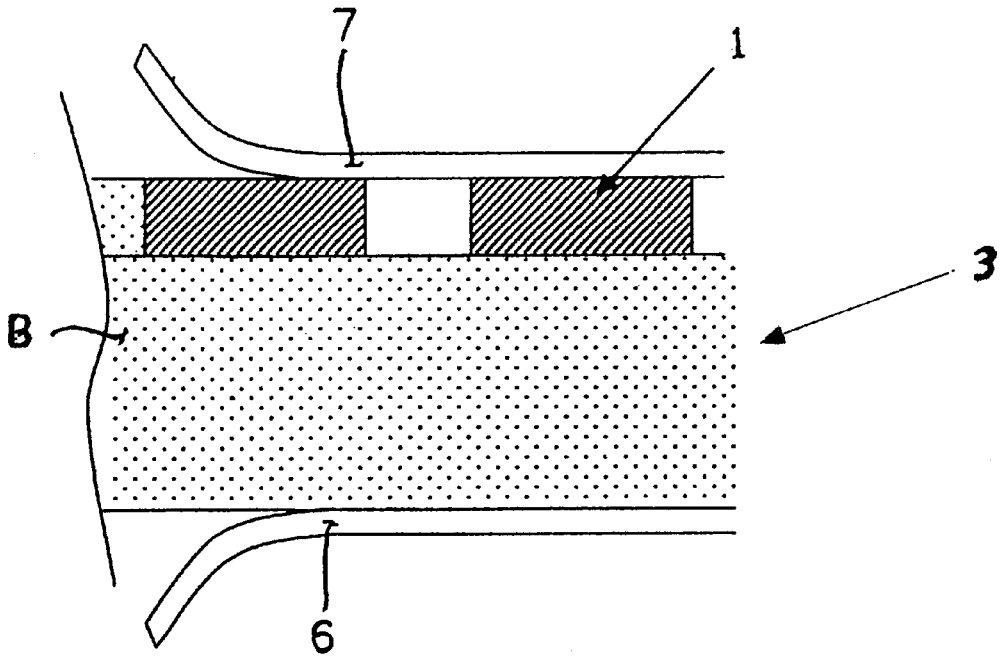
FIG. 9 is a partial sectional view illustrating a second embodiment of a sheet for forming the barrier ribs of FIGS. 4, 6, and 7.

The barrier rib B and the getter layer 1 according to the present invention may be formed by the stack and print method or the sand blasting method. Preferably, they may be formed as shown in FIGS. 8 and 9. As shown in FIGS. 8 and 9, a sheet 3 may he fabricated in such a manner that a glass powder for forming the barrier rib B and a getter material powder for forming the getter layer 1 are bonded by an organic binder such as a resin, thereby forming the barrier rib B and the getter layer 1. Then, the stripping member 6 is formed on the rear surface, and the protection film 7 is formed on the upper surface.

Accordingly, by using the sheet 3, the barrier rib B and the getter layer 1 on the PDP can be formed as follows.

Figure 1:
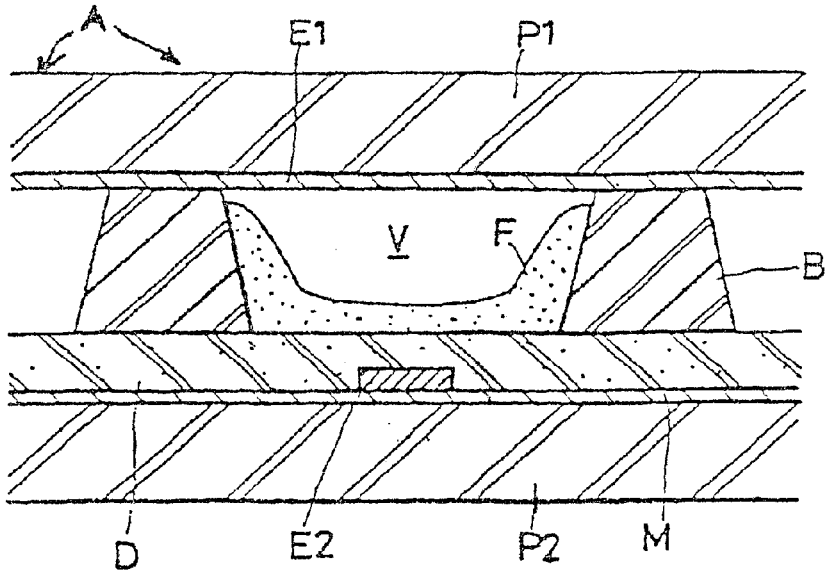
FIG. 1 is a partially sectional view illustrating a conventional discharging cell structure of a PDP.
Figure 2:
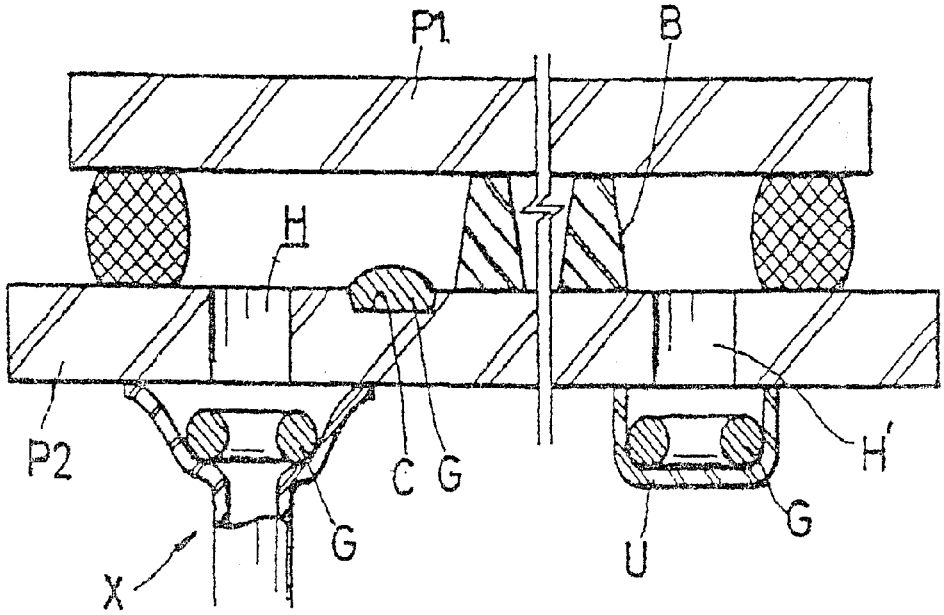
FIG. 2 are sectional views illustrating a conventional PDP having a getter installed therein.

That is, after forming address electrodes E2 on the lower substrate in FIGS. 3 and 5, but after forming the address electrodes E2 on the lower layer M in FIG. 1, the stripping paper 6 and the protection film 7 of the sheet 3 are removed, and the barrier rib B and the getter layer 1 are attached on the lower substrate P2 and the lower layer M on which the address electrodes E2 are formed, thereby concurrently forming the barrier rib B and the getter layer 1, so that the resultant structure is sintered, thereby forming a solid state structure. Therefore, it is possible to more easily form the getter layer 1 using the sheet 3 in which the barrier rib B and the getter layer 1 are formed.

The present invention may be implemented to a matrix-shape PDP and a transmissive type PDP. In addition, the present invention may be adapted to a PDP of a surface discharging or opposite electrode discharging structure.

As described above, in the PDP according to the present invention, the getter layer 1 is formed at a portion of the barrier rib B, so that the getter operation is performed at each discharging cell A, and the purity of the discharging gas is controlled for each discharging cell A. In addition, it is possible to extend the life span of the PDP by preventing a pollution of the discharging gas for a long time and to more easily fabricate the getter structure compared to the conventional getter structure.

Although the preferred embodiment of the present invention have been disclosed for illustrative purposes, those stilled in the art will appreciate that various modifications, additions and substitutions are possible, without departing from the scope and spirit of the invention as recited in the accompanying claims.

What is claimed is:

1. A plasma display panel (PDP) comprising an upper substrate and a lower substrate which are parallel to each other at a certain distance, a plurality of barrier ribs formed on the lower substrate for forming a discharging space, a plurality of address electrodes formed between each barrier rib, a plurality of display electrodes pairs formed on a surface of the upper substrate opposite to the lower substrate and crossing with the address electrodes, a plurality of discharging cells formed on at crossing portions between the address electrodes and the display electrodes, phosphor layers formed on at least a portion between each of the barrier ribs, and a discharging gas tightly filled in the discharging space between the upper substrate and the lower substrate, being characterized in that a getter layer is formed on at least one portion of the barrier ribs.

2. A PDP of claim 1, wherein said getter layer is formed of at least one or more compound selected from the group comprising Zr, Ti, V, Al, and Fe.

3. A PDP of claim 1, wherein a powder layer for forming the barrier rib and getter layer is formed of a sheet bonded by an organic binder, the barrier rib and getter layer being formed on the lower substrate by attaching to the lower substrate said bonded powder layer from the sheet, and sintering it.

4. A PDP of claim 1, wherein getter material particles of said getter layer are dispersed in an insulation material so that said getter layer has an electrical insulation characteristic.

5. A PDP of claim 1, wherein said getter layer is independently formed with respect to each of the discharging cells.

6. A PDP of claim 5, wherein said getter layer is formed at every other cell to be crossed each other with respect to the discharging cells formed in a direction that each barrier rib is extended.

7. A PDP of claim 1, wherein said getter layer is formed of a metallic compound.

8. A PDP of claim 7, wherein said metallic compound has a black color.

* * * * *